US007789722B2

(12) United States Patent
Shimizu et al.

(10) Patent No.: US 7,789,722 B2
(45) Date of Patent: Sep. 7, 2010

(54) TERMINALS AND A TERMINAL CONNECTING STRUCTURE

(75) Inventors: Tooru Shimizu, Yokkaichi (JP); Yuuji Takahashi, Yokkaichi (JP); Masatsugu Hachiga, Gotenba (JP); Tomio Shiraki, Gotenba (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/358,800

(22) Filed: Jan. 23, 2009

(65) Prior Publication Data

US 2009/0191768 A1 Jul. 30, 2009

(30) Foreign Application Priority Data

Jan. 25, 2008 (JP) ..... 2008-015274

(51) Int. Cl.
*H01R 13/02* (2006.01)

(52) U.S. Cl. ..... 439/884

(58) Field of Classification Search ..... 439/884, 439/886, 852
See application file for complete search history.

(56) References Cited

U.S. PATENT DOCUMENTS 4,408,824 A * 10/1983 Weidler ..... 439/398
5,073,132 A * 12/1991 Nottrott ..... 439/884
5,681,187 A 10/1997 Fukushima et al.
5,690,518 A 11/1997 Roy et al.
5,695,352 A * 12/1997 Abe ..... 439/223
6,851,989 B2 * 2/2005 Maeda ..... 439/852
6,994,578 B1 * 2/2006 Chen ..... 439/291
2004/0209527 A1 10/2004 Chen
2006/0089058 A1 4/2006 Derleth et al.
2006/0205290 A1 * 9/2006 Narita ..... 439/884
2009/0017692 A1 * 1/2009 Kondo et al. ..... 439/660
2009/0130923 A1 * 5/2009 Kuwayama ..... 439/852
2009/0170381 A1 * 7/2009 Sommovigo et al. ..... 439/884

FOREIGN PATENT DOCUMENTS

GB 993316 5/1965
GB 2342236 4/2000
JP 2006-294496 10/2006

* cited by examiner

*Primary Examiner*—Gary F. Paumen
(74) *Attorney, Agent, or Firm*—Gerald E. Hespos; Michael J. Porco

(57) ABSTRACT

In terminals (10, 20) to be connected by inserting a tab (11) of one terminal (10) into a tubular portion (21) of the other terminal (20), a resiliently deformable resilient contact piece (23) is provided in the tubular portion (21) and includes a contact portion (24) to be brought into contact with the tab (11) inserted into the tubular portion (21), and a groove (13) is formed in a part of the contact portion (24) to be brought into sliding contact with the tab (11) or in a part of the tab (11) to come into sliding contact with the contact portion (24), both lateral edges (13S) of the groove (13) extending in oblique directions with respect to an inserting direction of the tab (11).

8 Claims, 18 Drawing Sheets

TERMINALS AND A TERMINAL CONNECTING STRUCTURE

BACKGROUND OF THE INVENTION

1. Field of the Invention

The invention relates to plated terminals and to a terminal connecting structure.

2. Description of the Related Art

Japanese Unexamined Patent Publication No. 2006-294496 discloses first and second terminals to be connected by inserting a tab of the first terminal into a tube of the second terminal. A vertically displaceable resilient contact piece is provided in the tube of the second terminal, and a contact portion projects from the upper surface of the resilient contact piece.

The tab of the first terminal engages the contact portion of the resilient contact piece and moves toward the back while resiliently displacing the resilient contact piece. The terminals are connected properly when the tab reaches a specified position in the tube, and thus a resilient restoring force of the resilient contact piece holds the tab tightly between the contact portion and a wall surface of the tube.

Tin plating often is applied to surfaces of terminals for corrosion prevention and an improvement in connection reliability. However, tin plating is soft and is scraped off by the sliding contact of the tab and the contact portion. The scraped-off tin plating is pushed by the tab and accumulates at a front end with respect to an inserting direction of the tab. The accumulated tin plating needs to be pushed aside when the tab reaches the vicinity of the top of the contact portion so that the tab can be inserted further toward the back. Therefore a larger insertion force is necessary. The insertion resistance of a multipolar connector is the sum of insertion resistances of the individual terminals and hence a considerable force can be required to connect a multipolar connector. This presents a problem of poor operability.

The invention was developed in view of the above situation and an object thereof is to reduce an insertion resistance.

SUMMARY OF THE INVENTION

The invention relates to a terminal connecting structure for two plated terminals to be connected by inserting a tab of a first of the terminals into a tube of a second of the terminals. A resiliently deformable contact piece is provided in the tube and includes a contact portion to be brought into contact with the tab inserted into the tube. The tab slides in contact with the contact portion and moves forward in the tube while resiliently deforming the contact piece. The terminals are connected properly when the tab moves forward to a specified depth in the tube. At least one groove is formed in a part of the contact that slides contact with the tab and/or in a part of the tab that slides in contact with the contact portion. One or both lateral edges of the groove extend in oblique directions with respect to an inserting direction of the tab.

Sliding contact positions of the tab and the contact portion are displaced laterally with respect to the inserting direction of the tab, which is the direction in which the scraped-off plating is pushed aside. Accordingly, the scraped-off plating will not accumulate, and no large force is necessary to push the plating aside. Further, sliding contact paths of the tab and the contact portion extend in two different directions. Thus, a contact area is increased and a contact pressure is reduced by that much as compared with paths that are not separated. Accordingly, no large force is necessary to push the plating aside and the contact pressure is reduced. Therefore the insertion resistance of the terminal can be reduced.

The groove may be narrowed or widened in the inserting direction of the tab. Thus, the sliding contact positions of the tab and the contact portion are laterally displaced with respect to the inserting direction of the tab (direction in which the scraped-off plating is pushed aside).

A track of sliding contact of the tab may extend back along the lateral edges of the groove from an intermediate position of the groove and may extend substantially straight back from the rear end of the groove.

A maximum depth of the groove may be smaller than a maximum width thereof and/or a length of the groove in forward and backward directions may be larger than about twice a maximum width of the groove.

A position of the groove where the width of the groove is largest may serve as a starting point where the contact portion and the tab start to engage, and/or the rear end position of the groove may serve as an ending position of a sliding contact part with the contact portion or the tab.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
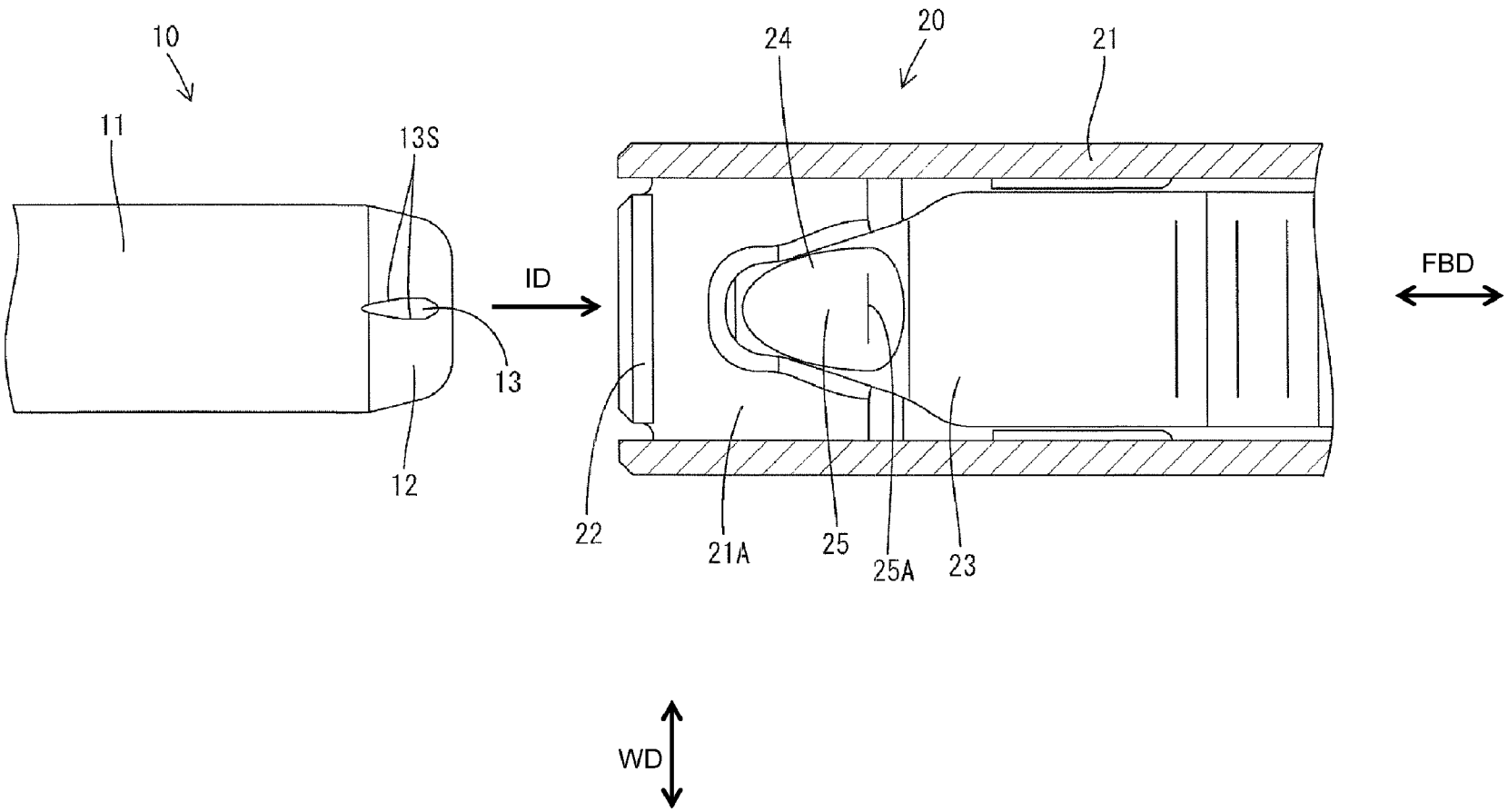
FIG. 1 is a plan view in section showing a state before a female terminal and a male terminal according to a first embodiment are connected.
Figure 2:
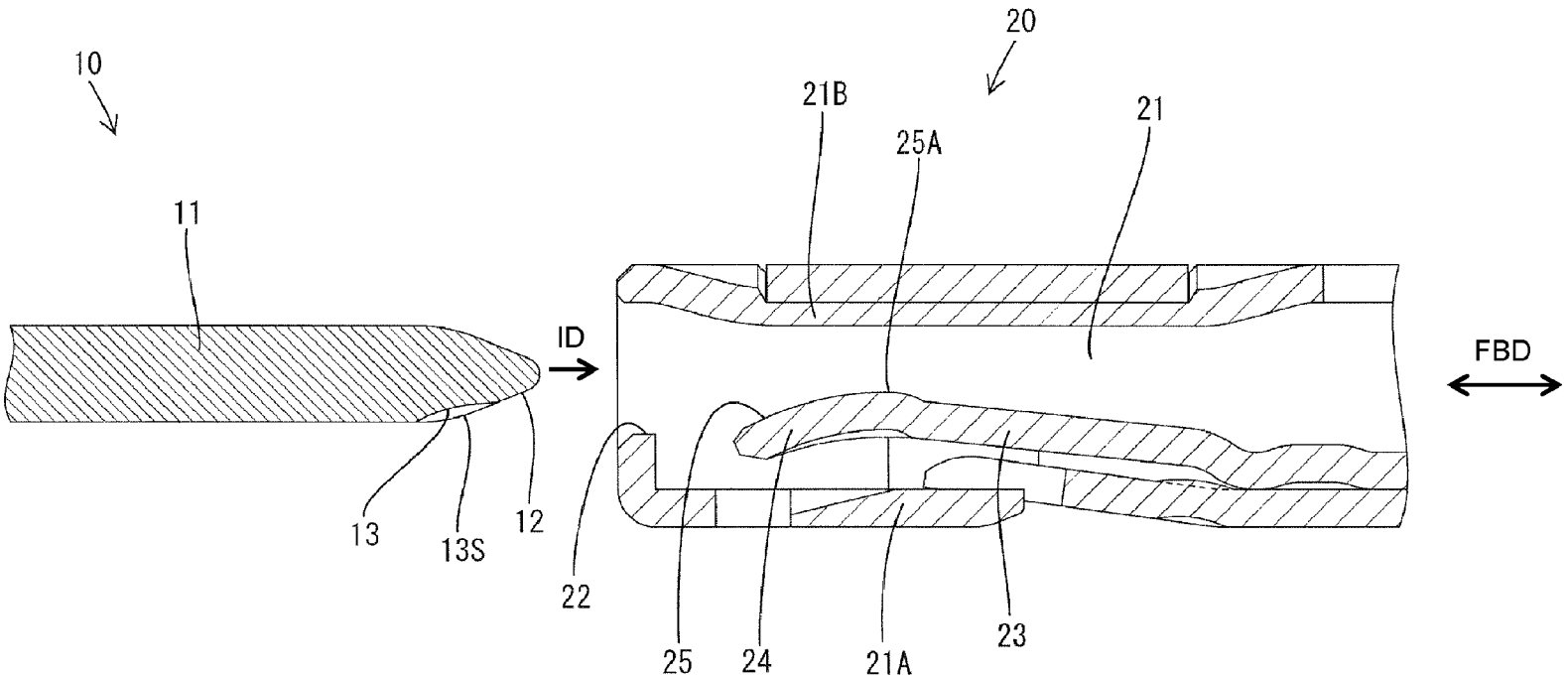
FIG. 2 is a side view in section of the state of FIG. 1.
Figure 3:
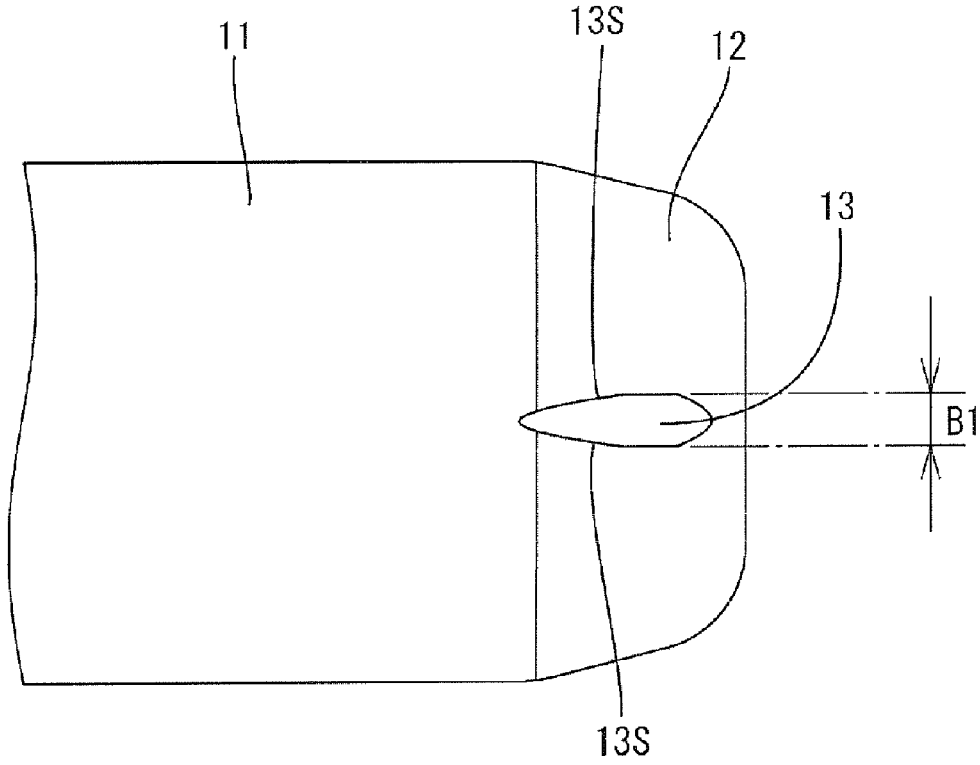
FIG. 3 is a plan view of a tab.
Figure 4:
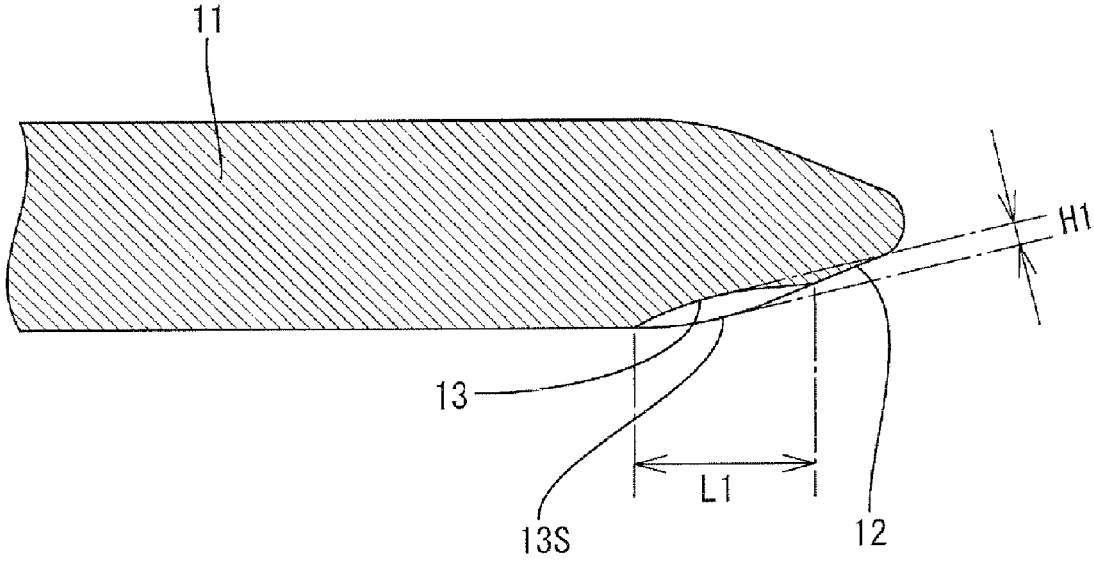
FIG. 4 is a side view in section of the tab.
Figure 5:
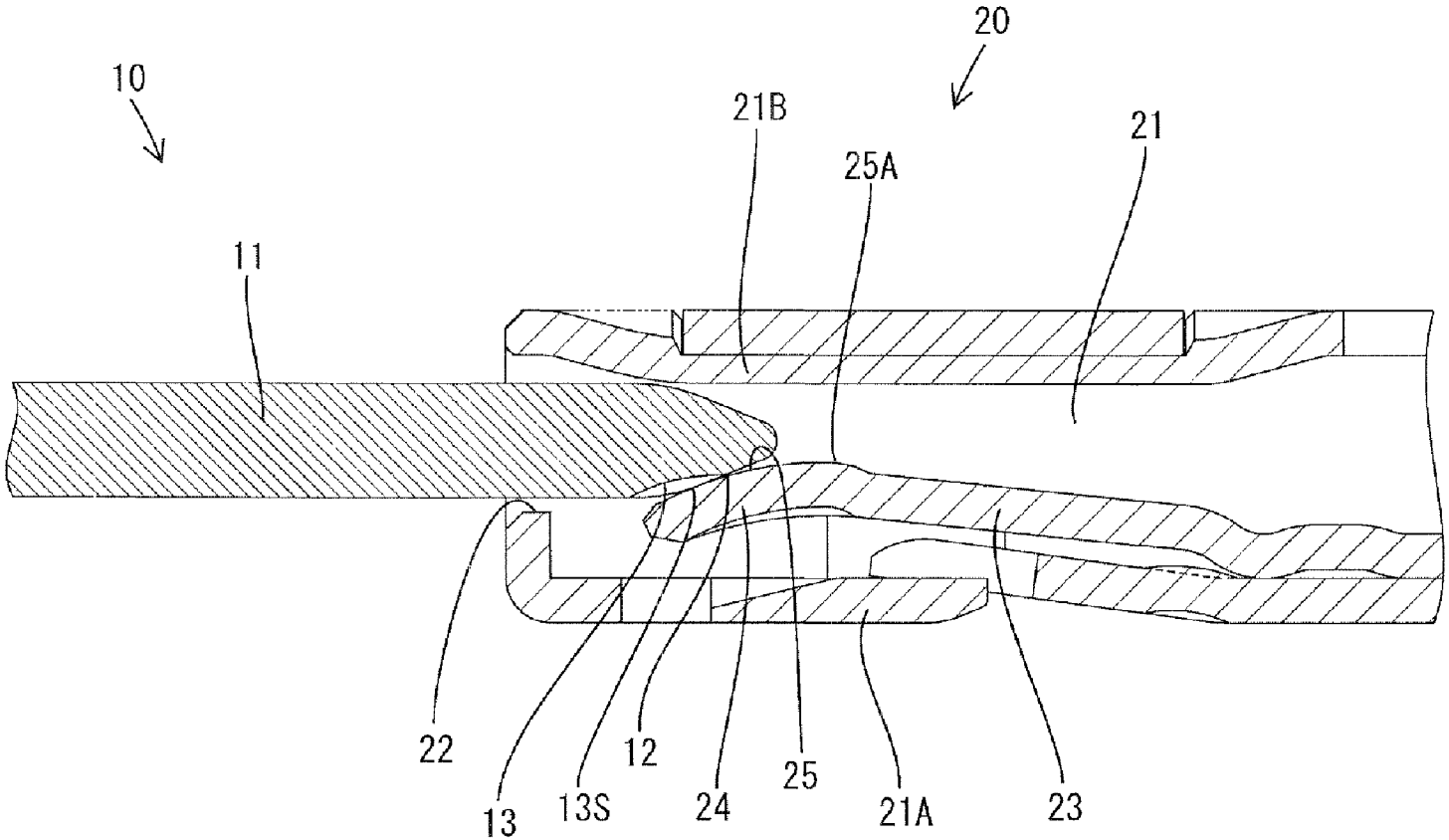
FIG. 5 is a side view in section showing a state where the contact of the tab and a contact portion starts.
Figure 6:
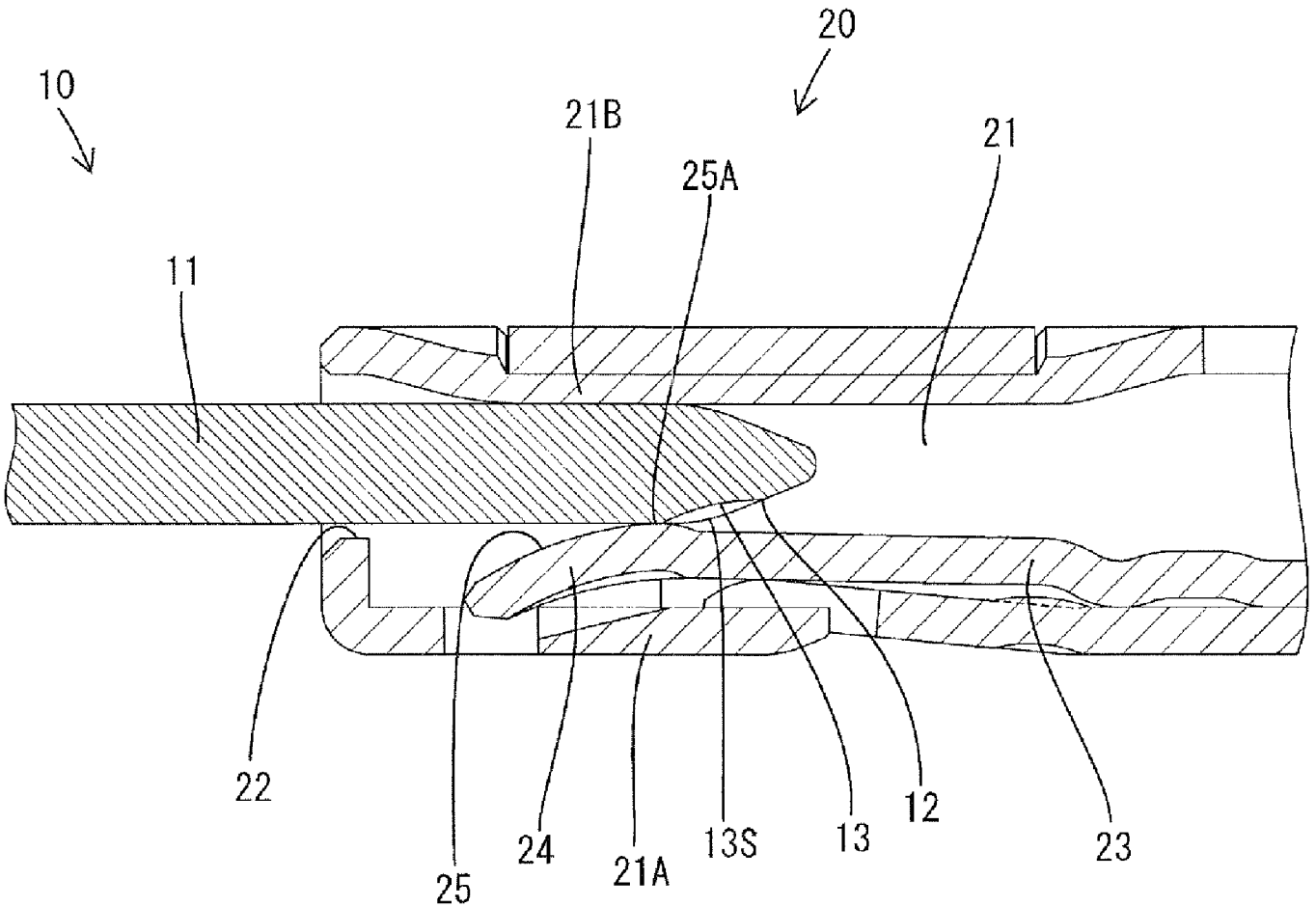
FIG. 6 is a side view in section showing a state where the tab moves over a top of the contact portion.
Figure 7:
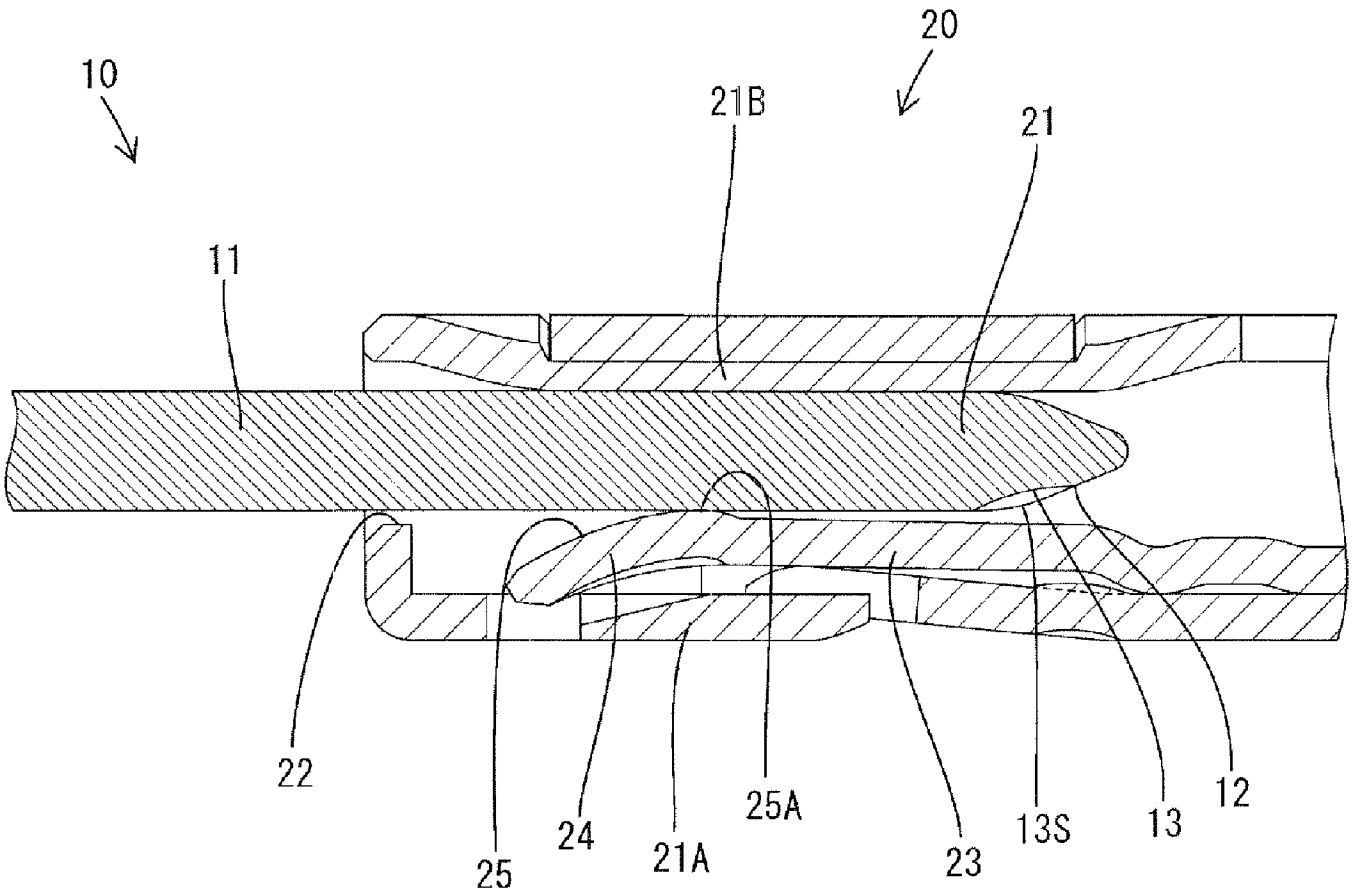
FIG. 7 is a side view in section showing a state where the male terminal and the female terminal are properly connected.

Male and female terminals according to a first embodiment of the invention are identified respectively by the numerals 10 and 20 in FIGS. 1 to 8. The terminals 10, 20 are connected with each other by inserting a tab 11 of the male terminal 10 into a tube 21 of a female terminal 20. The terminals 10, 20 are plated or coated with metal, and preferably are tin-plated. In the following description, connecting ends of the terminals 10, 20 are referred to as the front ends and the terms upper and lower refer to the orientation shown in FIG. 2.

The female terminal 20 is formed by bending, folding and/or embossing a punched-out electrically conductive metal plate. The female terminal 20 is long and narrow in forward and backward directions FBD. A rear part of the female terminal fitting 20 is crimped, bent or folded into connection with an end of an unillustrated wire and a front part defines a tube 21 that is long in forward and backward directions FBD. A tab insertion hole 22 is formed at the front end of the tube 21 for receiving the tab 11 of the male terminal 10 in an inserting direction ID.

The tube 21 has a bottom wall 21A and a ceiling wall 21B that is opposite the bottom wall 21A. A resilient contact piece 23 is cantilevered obliquely forward and up from the bottom wall 21A toward the ceiling wall 21B when the resilient contact piece 23 is in a natural undeflected state. However, the resilient contact piece 23 can be displaced vertically down in the tube 21.

A contact portion 24 is provided at the leading end of the resilient contact piece 23 and can be brought into contact with the tab 11 inserted into the tube 21. The tab 11 is held tightly between the contact portion 24 and the ceiling wall 21B to contact the male and female terminals 10 and 20 electrically.

A female-side sliding contact surface 25 is defined at the front of the contact portion 24 and can slide in contact with the tab 11. The female-side sliding contact surface 25 is inclined moderately down and out toward the front, and hence is inclined with respect to the inserting direction ID to approach the ceiling wall 21B toward the back when the resilient contact piece 23 is in the natural state. The vertical spacing between rear parts of the female-side sliding contact surface 25 and the ceiling wall 21B is smaller than the thickness of the tab 11 of the male terminal 10 when the resilient contact piece 23 is in the natural state. Further, the female-side sliding contact surface 25 can be seen from front of the tube 21 through the tab insertion hole 22 when the resilient contact piece 23 is in the natural state.

The contact portion 24 has a top 25A that defines the part of the contact portion 24 closest to the ceiling wall 21B. The top 25A is near the rear end of the female-side sliding contact surface 25 and near the front end of the tube 21. The top 25A of the contact portion 24 contacts a central part of the tab 11 in forward and backward directions FBD when the terminals 10, 20 are connected properly, and hence the top 25A is spaced back from the front of the tab 11 by a specified effective margin. Thus, a proper connection between the two terminals 10, 20 can be maintained reliably even if the terminals 10, 20 are relatively displaced in forward and backward directions FBD provided that any such displacement is in the range of the effective margin.

The male terminal 10 also is formed by bending, folding and/or embossing a punched-out or cut electrically conductive plate material preferably made of metal. The male terminal 10 is long and narrow in forward and backward directions FBD. A rear end of the male terminal 10 is to be crimped, bent or folded into connection with an end of an unillustrated wire and a front part of the male terminal 10 defines the long narrow tab 11.

The tab 11 is a plate with a lateral dimension that is larger than a vertical dimension. Thus, the connected state is maintained even if the two properly connected terminals 10, 20 are displaced relatively in lateral directions, provided that this displacement lies in the range of the lateral dimension of the tab 11. Upper and lower surfaces of a leading end of the tab 11 are inclined to come closer to each other toward the leading end. A male-side sliding contact surface 12 is defined on the lower surface of the tab 11 and slides in contact with the contact portion 24 of the female terminal 20.

A groove 13 extends in forward and backward directions FBD at a widthwise middle position of the male-side sliding contact surface 12 from a rear portion of the male-side sliding contact surface 12 to a position near the front end. The groove 13 has lateral edges 13S that are separated in two directions to extend substantially forward from the rear end of the male-side sliding contact surface 12. The spacing between the lateral edges 13S is increased gradually toward the front and the width of the groove 13 is maximized at a position near the front end of the groove 13. A position of the groove portion 13 slightly behind the position with the largest width defines a starting point where contact with the contact portion 24 starts, and the rear end position of the groove 13 defines an ending position for first moving over the top 25A of the contact portion 24. The groove portion 13 extends forward beyond the starting position and is configured so that parts other than the groove 13 are not to be brought into contact with the female-side sliding contact surface 25. More particularly, the groove 13 never fails to first come into contact, even if the tab 11 is inserted into the tab insertion hole 22 in an oblique posture slightly inclined down toward the front. The depth of the groove portion 13 is largest at a central position thereof in forward and backward directions.

A maximum width B1 of the groove 13 is about 0.15 mm. A maximum depth H1 of the groove 13 is smaller than the maximum width B1, preferably about half or less than the maximum width B1 or about 0.07 mm. A length L1 of the groove 13 in forward and backward directions is larger than about twice the maximum width B1, more preferably more than about three times the maximum width B1, and most preferably about 0.55 mm (see FIGS. 2 and 3). These preferred dimensions are not limitations and can be varied for particular circumstances.

The two terminals 10, 20 are brought closer to each other with the tab 11 of the male terminal 10 and the tab insertion hole 22 of the female terminal 20 substantially opposed to each other in forward and backward directions FBD. Thus, the tab 11 is inserted into the tube 21 through the tab insertion hole 22. A rear portion of the male-side sliding contact surface 12 of the tab 11 (part formed with the groove 13) comes into contact with a front portion, of the female-side sliding contact surface 25 (see FIG. 5). Thus, both lateral edges 13S of the groove 13 come into contact with the female-side sliding contact surface 25.

The tab 11 moves forward in the inserting direction ID when the two terminals 10, 20 are brought further closer and widens the spacing between the female-side sliding contact surface 25 and the ceiling wall 21B. In the meantime, the both lateral edges 13S of the groove 13 and the female-side sliding contact surface 25 come into sliding contact and the resilient contact piece 23 is deformed resiliently down and out in a direction intersecting the inserting direction ID. The lateral edges 13S of the groove 13 are inclined to be more distant from each other toward the front (in an inserting direction ID of the tab 11). Thus, the sliding contact positions of the tab 11 and the contact portion 24 (i.e. sliding contact positions of both lateral edges 13S of the groove 13 and the female-side sliding contact surface 25) are displaced gradually inwardly (toward sides approaching each other) as the tab 11 moves forward in the inserting direction ID. Specifically, when contact of the tab 11 with the contact portion 24 starts, there are two sliding contact positions spaced apart in a width direction WD. As the tab 11 moves forward, the two sliding contact positions move back and come closer to each other. At this time, plating scraped off by the sliding contact of the lateral edges 13S of the groove 13 and the female-side sliding contact surface 25 is pushed aside forward of the sliding contact positions (laterally with respect to a sliding contact direction). Then, the rear end of the male-side sliding contact surface 12 of the tab 11 (rear end of the groove 13) reaches the rear end of the female-side sliding contact surface 25 (top 25A of the contact portion 24) (see FIG. 6). The two terminals 10, 20 are brought even closer so that the tab 11 is inserted to a proper position in the tube 21, and the two terminals 10, 20 are connected properly (see FIG. 7).

Figure 8:
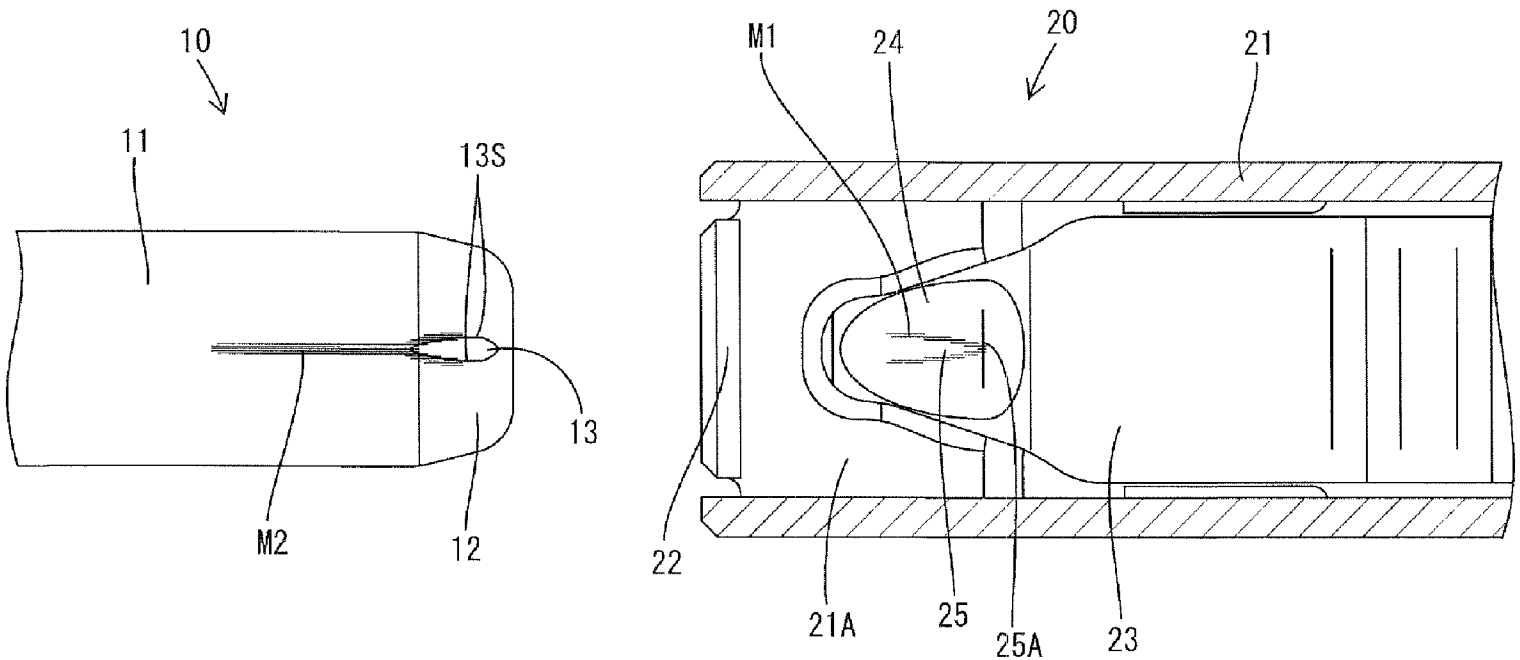
FIG. 8 is a plan view showing tracks of sliding contact of the tab and the contact portion.
Figure 9:
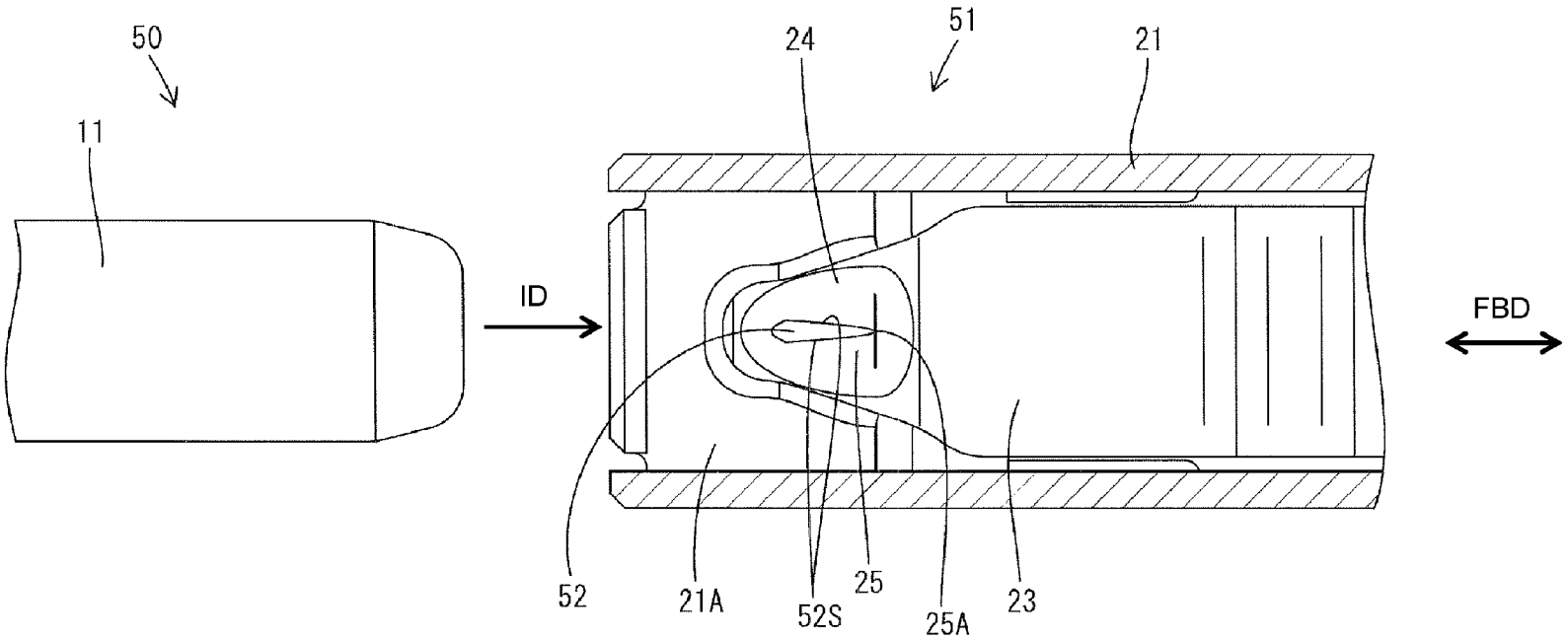
FIG. 9 is a plan view in section showing a state before a female terminal and a male terminal according to a second embodiment are connected.
Figure 10:
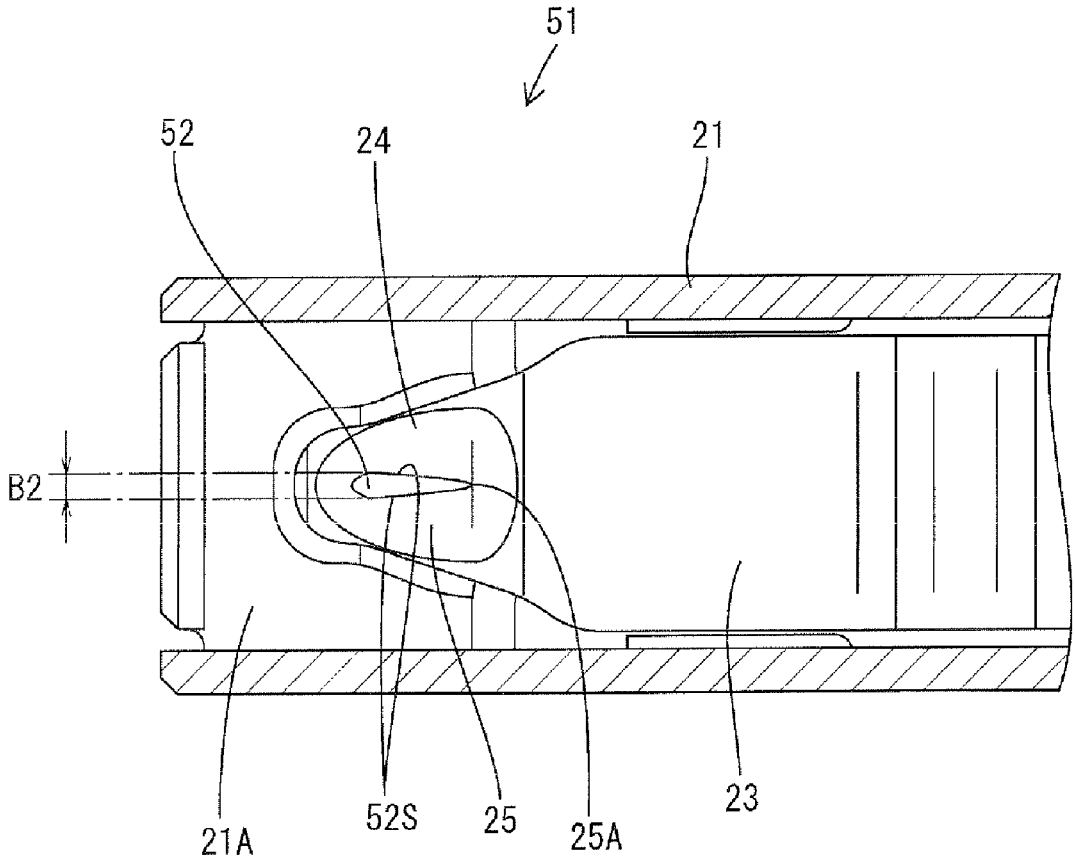
FIG. 10 is a plan view of the female terminal.
Figure 11:
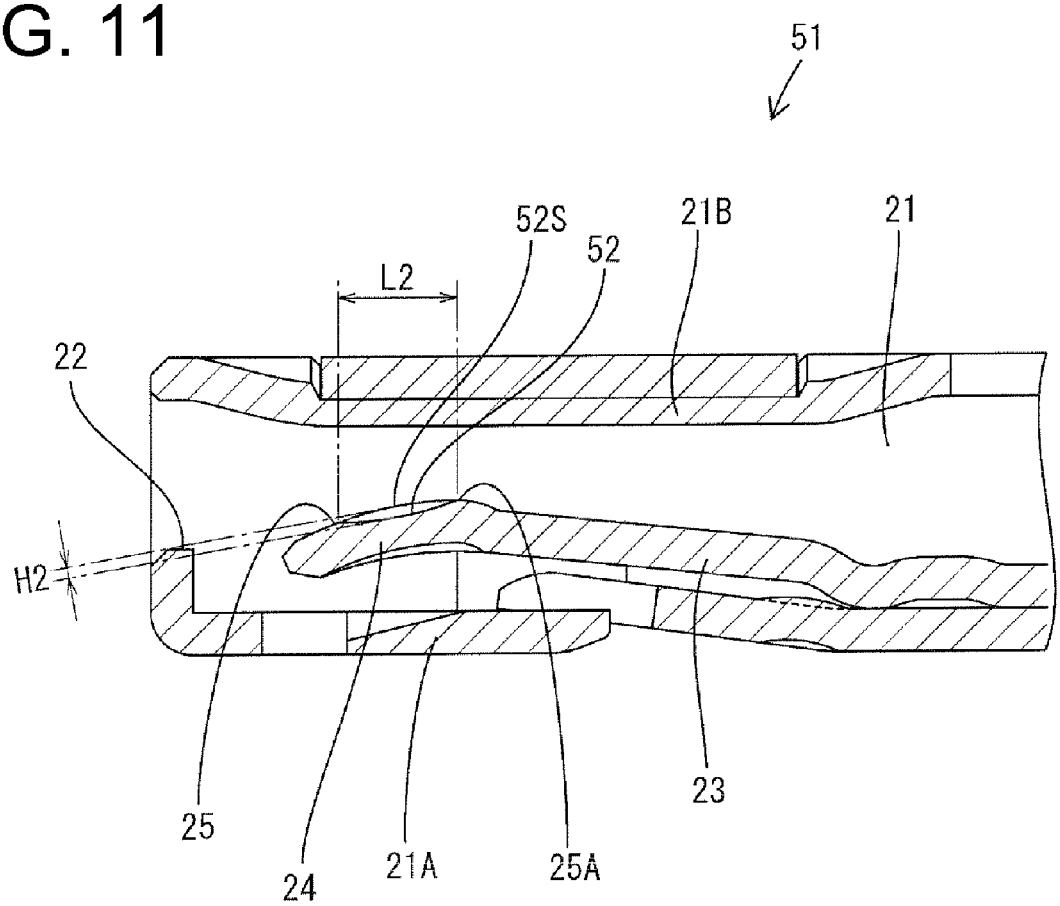
FIG. 11 is a side view in section of the female terminal.
Figure 12:
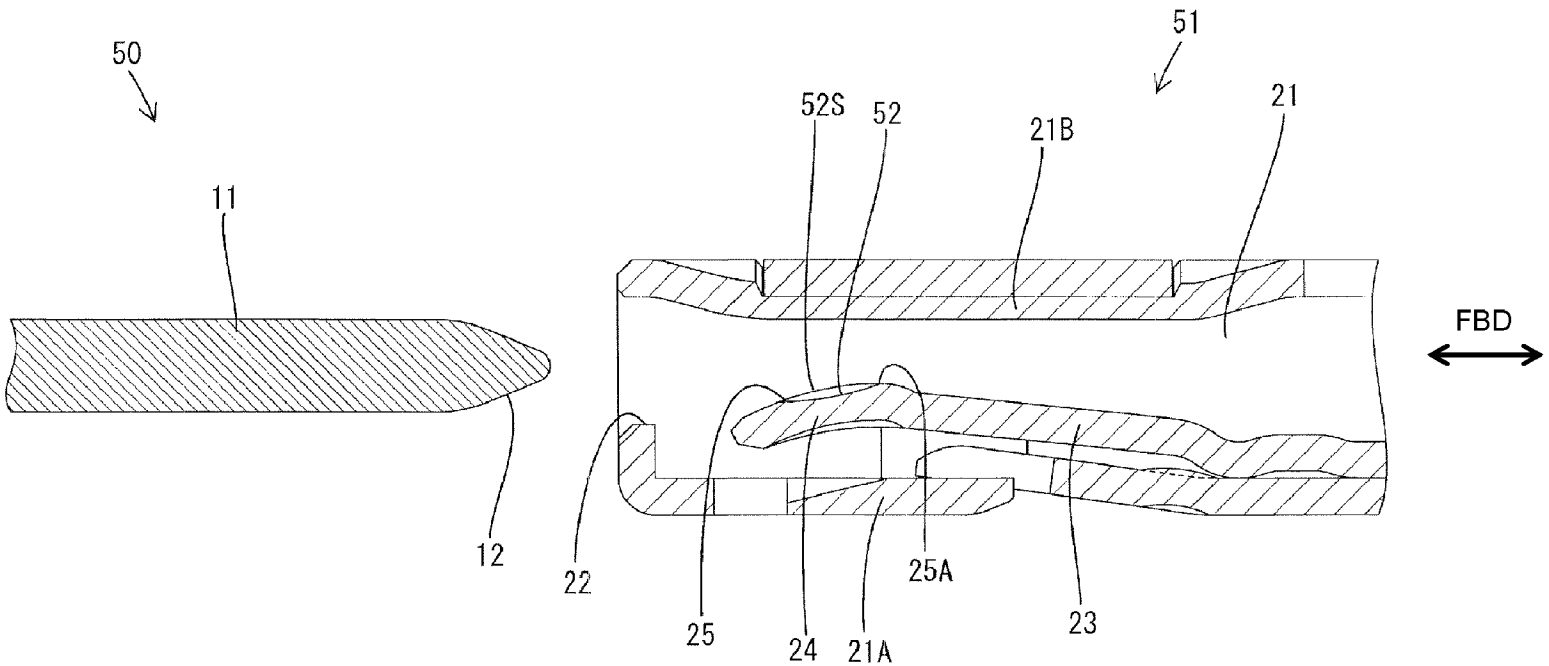
FIG. 12 is a side view in section showing the state before the female terminal and the male terminal are connected.
Figure 13:
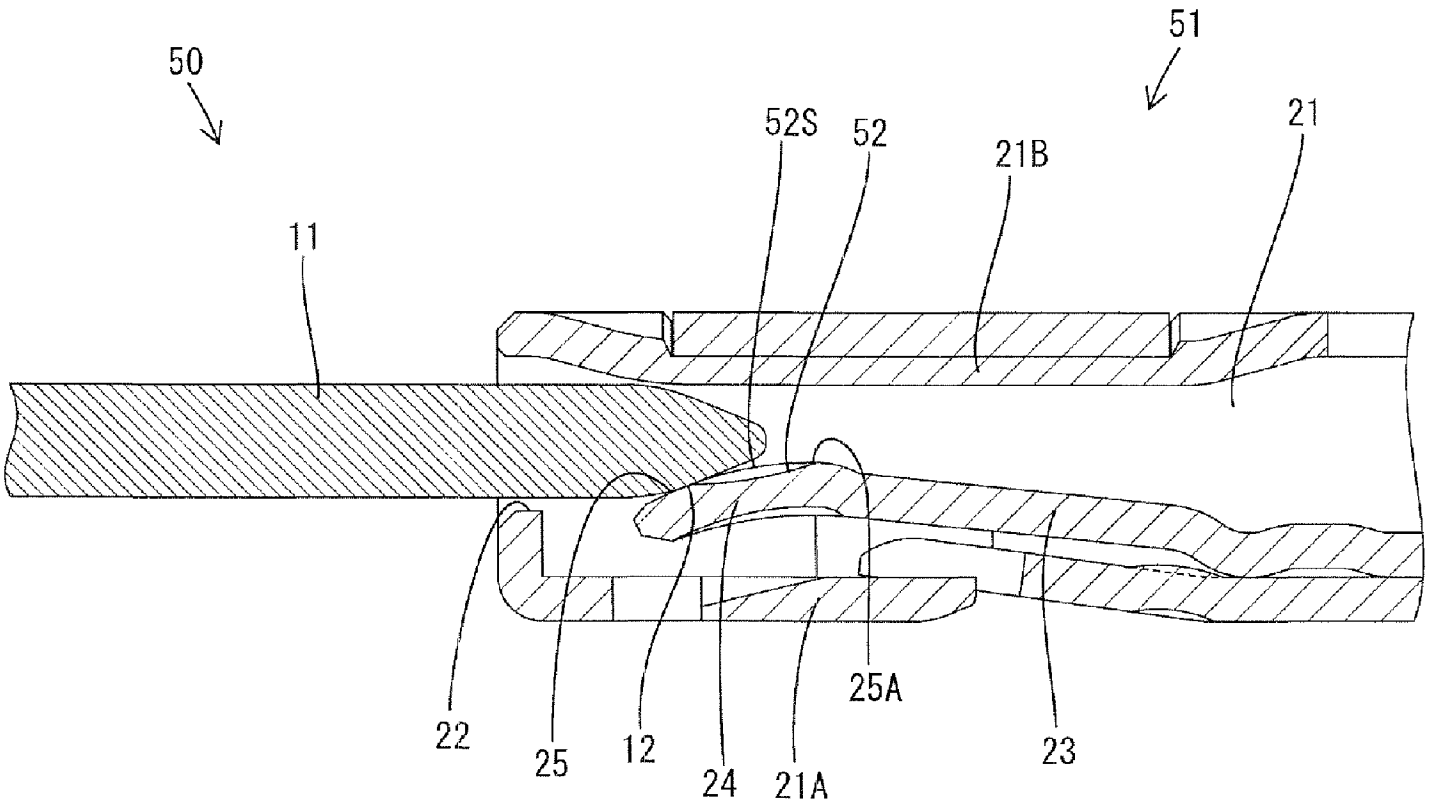
FIG. 13 is a side view in section showing a state where the contact of a tab and a contact portion starts.
Figure 14:
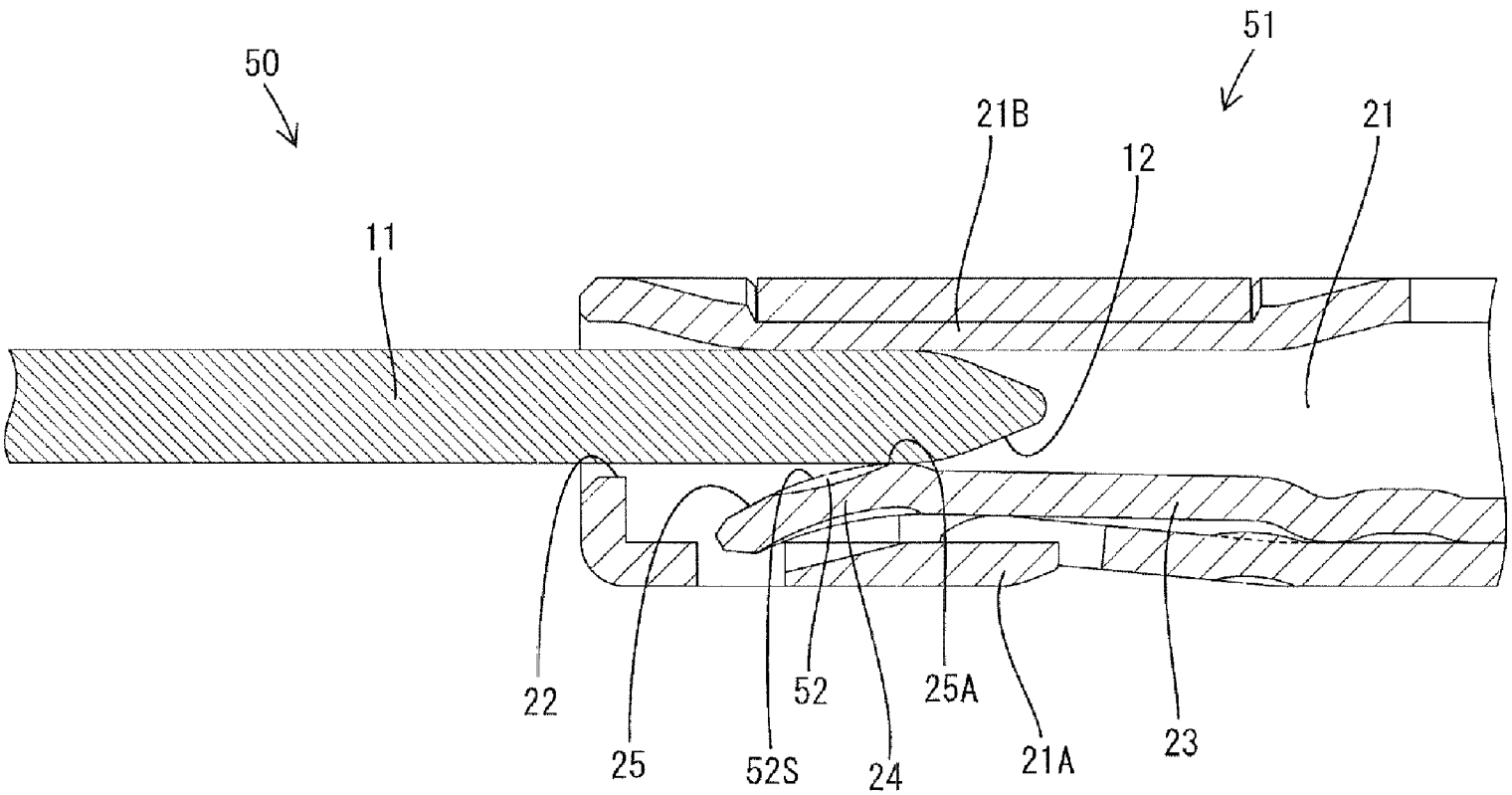
FIG. 14 is a side view in section showing a state where the tab moves over a top of the contact portion.
Figure 15:
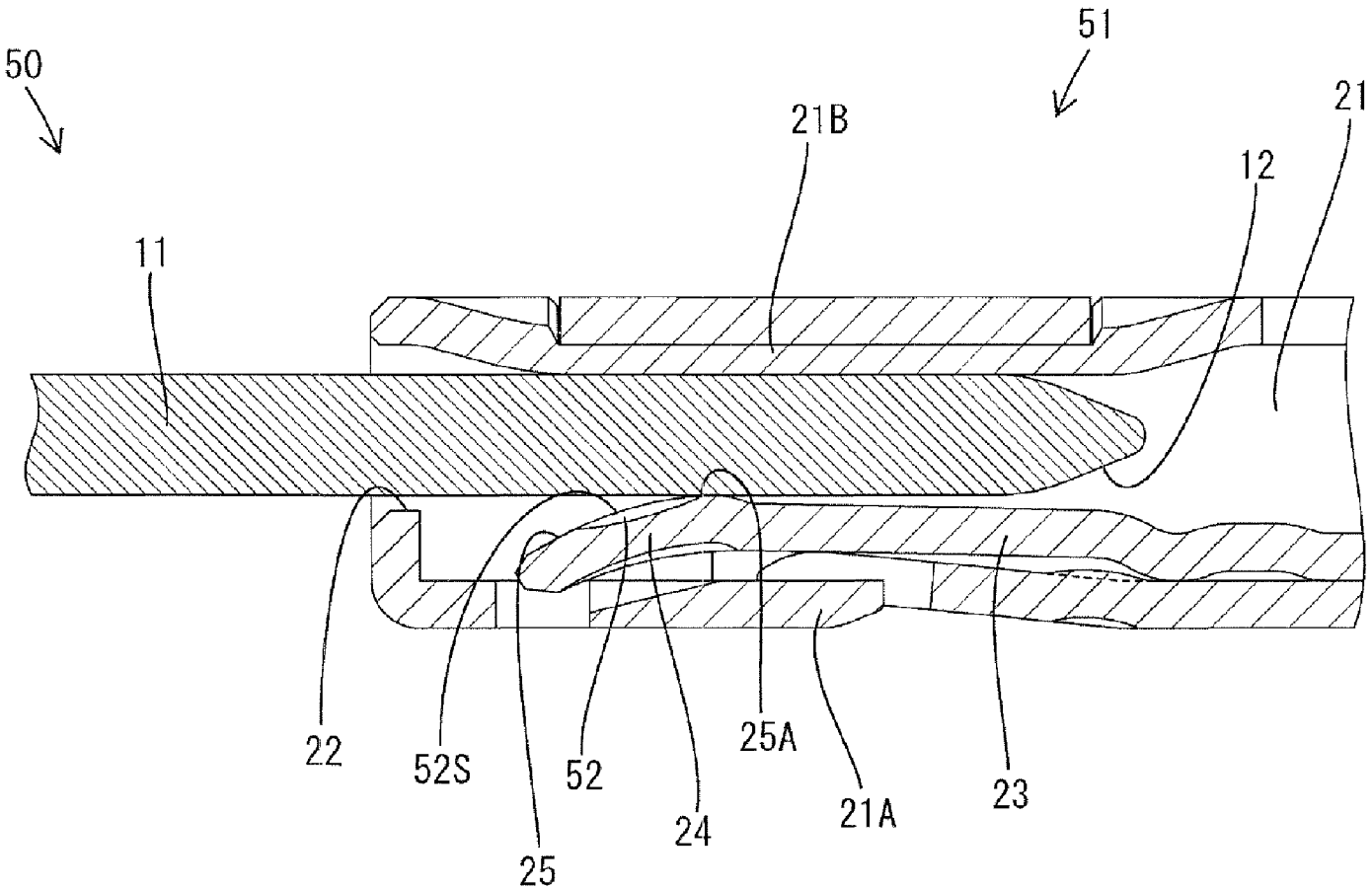
FIG. 15 is a side view in section showing a state where the male terminal and the female terminal are properly connected.
Figure 16:
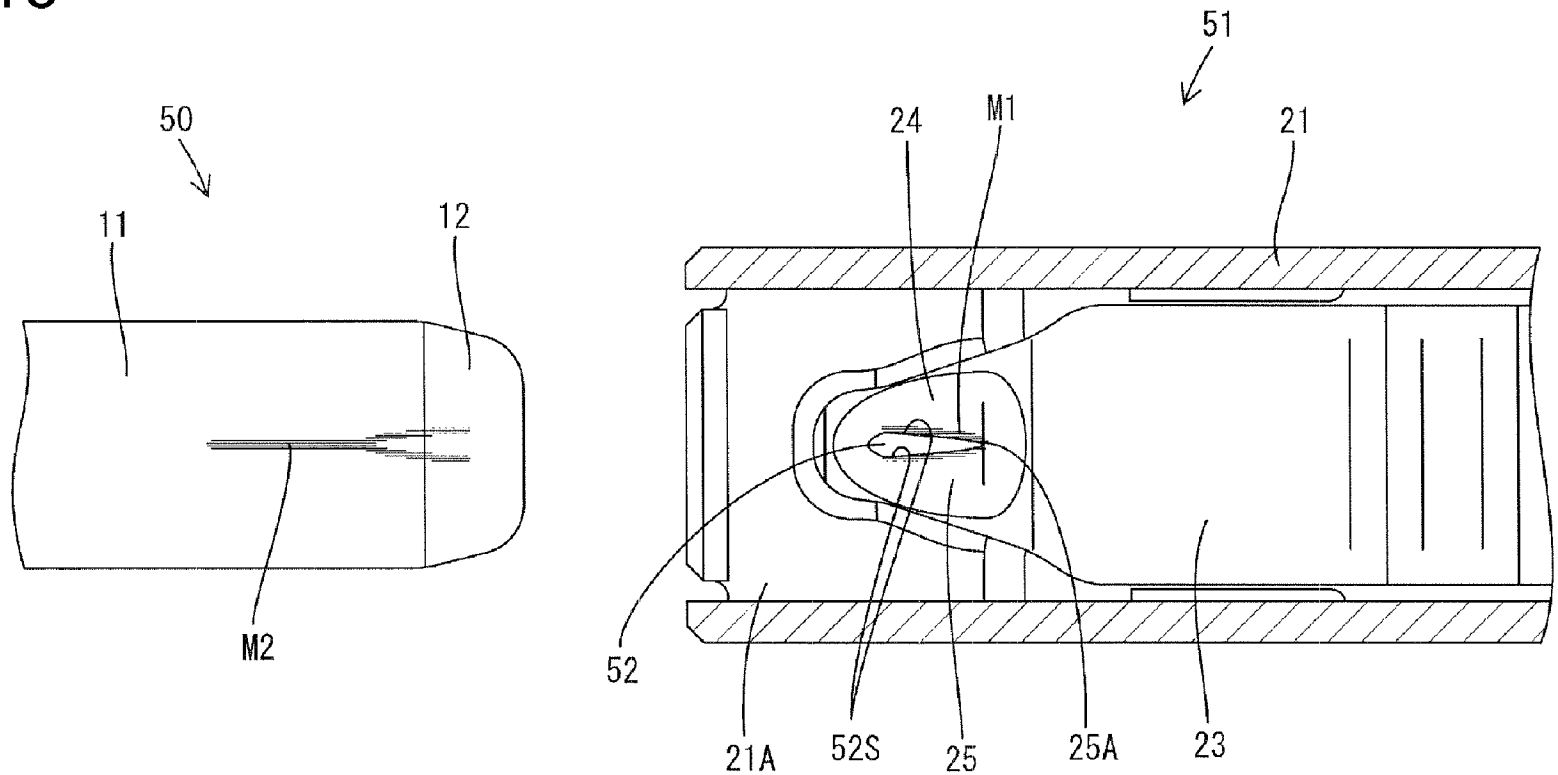
FIG. 16 is a plan view in section showing tracks of sliding contacts of the tab and the contact portion.

FIG. 8 shows tracks of sliding contact M1, M2 until the two terminals 10, 20 reach proper connected positions after the contact of the tab 11 with the contact portion 24 starts. The track of sliding contact M1 of the female-side sliding contact surface 25 has a substantially V shape open to the front, and the rear end thereof is located at the top 25A of the contact portion 24. Specifically, the sliding contact paths of the male-side sliding contact surface 12 up to the top 25A are forked in two directions. When the male-side sliding contact surface 12 passes the top 25A, only the top 25A contacts the tab 11 to ensure a specified contact pressure.

The track of sliding contact M2 of the male-side sliding contact surface 12 extends back along the lateral edges 13S of the groove 13 from an intermediate position of the groove 13 (intermediate positions of both lateral edges) and extends substantially straight back from the rear end of the groove 13 (rear end of the male-side sliding contact surface 12). The front end of this track of sliding contact M2 is a starting position where the contact with the female-side sliding contact surface 25 starts, and the rear end of the male-side sliding contact surface 12 is an ending position which reaches the top 25A of the contact portion 24. The rear end position of the track of sliding contact M2 is held in contact with the top 25A of the contact portion 24 when the two terminals 10, 20 are connected properly.

Figure 17:
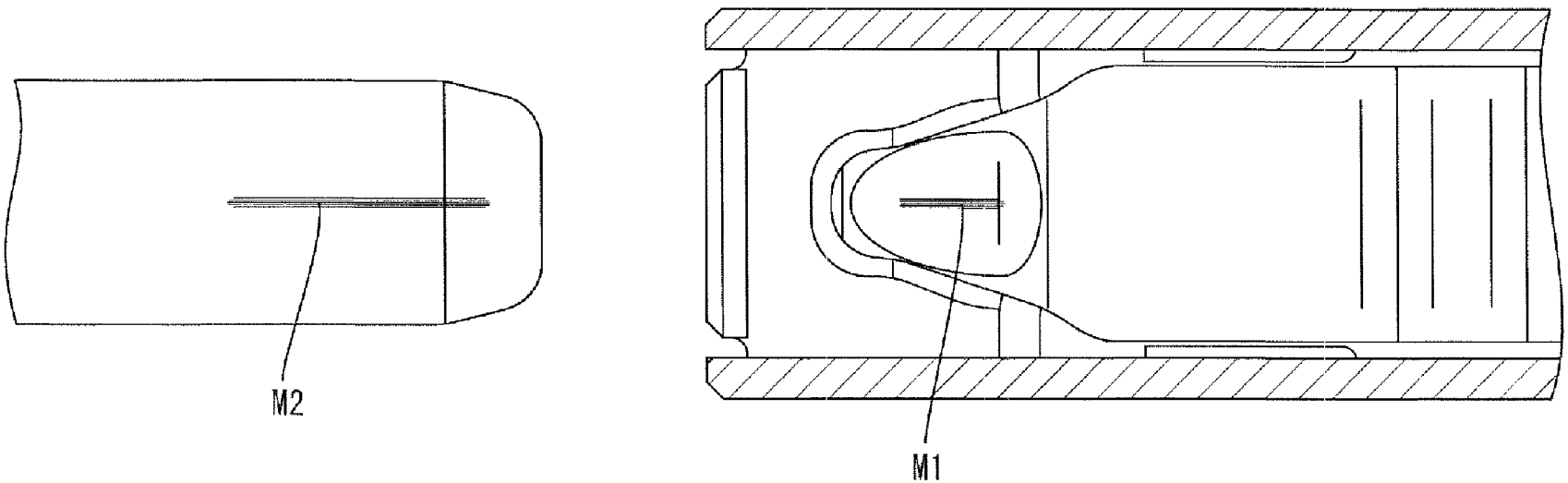
FIG. 17 is a plan view in section showing tracks of sliding contact of conventional tab and contact portion.
Figure 18:
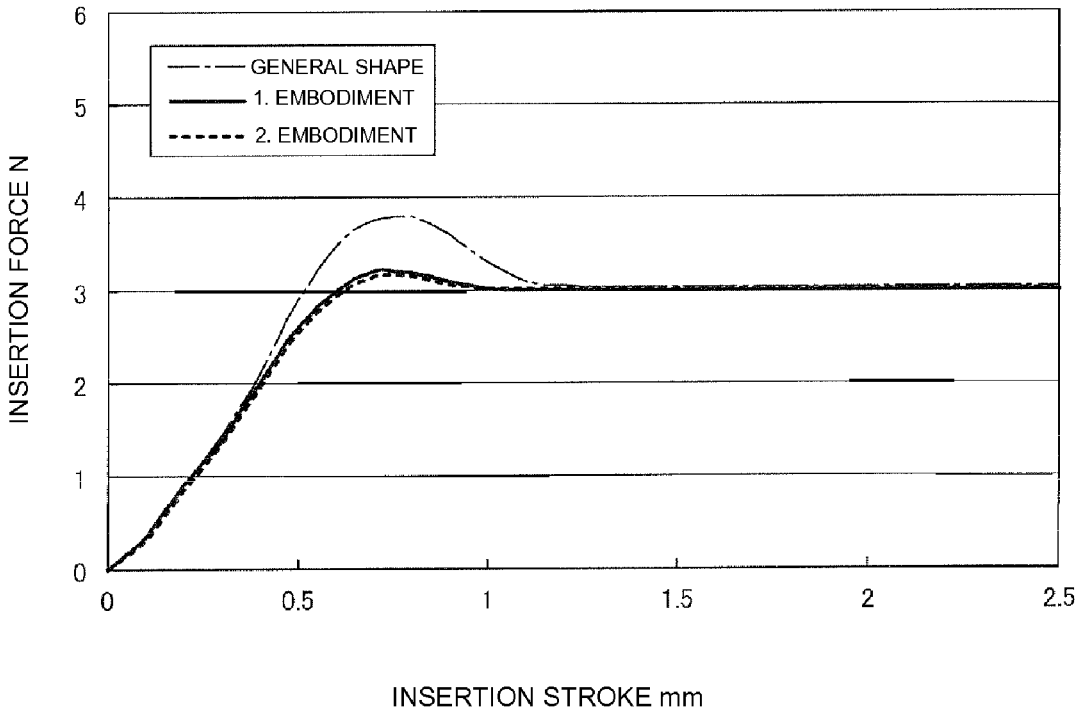
FIG. 18 is a graph showing relationships of an insertion stroke and an insertion force.

FIG. 18 is a graph showing a relationship of an insertion stroke and an insertion force (insertion resistance) of the male terminal 10 (a relationship of an insertion stroke and an insertion force relating to the connection of the terminals 10, 20 of the first embodiment are shown by solid line). The value of the insertion force of the male terminal 10 increases gradually after the contact of the tab 11 with the female-side sliding contact surface 25 starts, reaches a moderate peak when the tab 11 passes the vicinity of the top 25A of the contact portion 24 and, thereafter, becomes constant or substantially constant. This graph also shows a relationship of an insertion stroke and an insertion force relating to the connection of conventional terminals (those not formed with the groove portion 13) by dashed-dotted line. FIG. 17 shows tracks of sliding contact M1, M2 at that time. In the case of connecting the conventional terminals, a peak value when a tab passes the vicinity of a top of a contact portion is very large as shown in the graph of FIG. 18. The peak value increases in such a way for the following reason. If the tab has no groove, a sliding contact path of the tab and the contact portion is a straight line extending in forward and backward directions as shown by the track of sliding contact M2 of FIG. 17. Then, plating scraped off by the sliding contact of the tab and the contact portion is pushed aside forward as the tab moves forward, and the tab moves forward while pushing the plating pushed aside on the sliding contact path forward. Thus, the plating is accumulated on the top of the contact portion and a force for pushing the accumulated plating aside is necessary to insert the tab further toward the back side. Therefore, the peak value of the insertion force in the vicinity of the top becomes very large.

However, the sliding contact paths are displaced in oblique directions (directions different from the one in which the plating is pushed aside) in this invention. Thus, there is no or very little likelihood of accumulating the plating in the vicinity of the top 25A. Accordingly, no force is necessary for pushing the plating aside and the peak value of the insertion force is decreased. Since the sliding contact path of the tab 11 and the contact portion 24 is forked or divided, a contact area increases as compared with the case where the tab 11 and the contact portion 24 come into sliding contact on a straight line. Therefore, a contact pressure can be reduced by that much.

According to the above-described construction, no or very little force for pushing the plating aside is necessary and the contact pressure is reduced. Thus, the peak value of the insertion force (insertion resistance) of the terminals 10, 20 is reduced significantly and the insertion resistance is decreased more drastically than before. Therefore, a force required to connect the connectors can be reduced and operability for this connecting operation is improved.

As described above, both lateral edges 13S of the groove 13 are inclined to be more distant from each other in the inserting direction ID of the tab 11. Thus, the sliding contact positions of the tab 11 and the contact portion 24 gradually are displaced laterally with respect to the inserting direction ID of the tab 11. Thus, there is no likelihood of accumulating the scraped-off plating at one position, with the result that no force for pushing the plating aside is necessary. Further, the sliding contact path of the tab 11 and the contact portion 24 is forked or divided. Thus, the contact area increases and the contact pressure is reduced by that much as compared with the case where the path is not forked. In other words, no force for pushing the plating aside is necessary and the contact pressure is reduced. Therefore, the insertion resistance of the terminals 10, 20 is reduced.

Terminals according to a second embodiment are described with reference to FIGS. 9 to 16. A male terminal 50 and a female terminal 51 according to this embodiment differ from those of the first embodiment in that a groove 52 is not formed in the male terminal 50, but in the female terminal 51. The same or similar construction as in the first embodiment is identified by the same reference numerals and is not repeatedly described.

The female terminal 51 of the second embodiment has a tube 21 for receiving a tab 11 of the male terminal 50 and a resilient contact piece 23 is provided in the tube 21. A contact portion 24 is provided at the resilient contact piece 23 to be brought into contact with the tab 11 inserted into the tube 21.

The groove 52 is formed in a female-side sliding contact surface 25 of the contact portion 24 is widened toward the front. The groove 52 extends substantially in forward and backward directions FBD at a widthwise intermediate position of the female-side sliding contact surface 25 from a rear portion (the rear end or top 25A) of the female-side sliding contact surface 25 to a position near the front end.

Both lateral edges 52S of the groove 52 are separated in two directions to extend substantially forward from the rear end of the female-side sliding contact surface 25, and the spacing therebetween is increased gradually toward the front so that the width of the groove 52 is maximized at a position near the front end of the groove 52. A position of the groove 52 where the width of the groove portion 52 is largest defines a starting point where contact with the tab 11 starts (see FIG. 16), and the rear end of the groove portion 52 defines an ending position of a sliding contact part with the tab 11. The depth of the groove portion 52 is largest at a central position in forward and backward directions.

In this embodiment, a maximum width B2 of the groove 52 is 0.15 mm. A maximum depth H2 of the groove 52 is smaller than the maximum width B1, preferably about half or less than the maximum width B1 or preferably about 0.06 mm. A length L2 of the groove 52 in forward and backward directions is larger than about twice the maximum width B1, more preferably more than about three times the maximum width B1, most preferably about 0.70 mm (see FIGS. 10 and 11). These dimensions may be changed.

Tracks of sliding contact M1, M2 (see FIG. 16) and a relationship of an insertion stroke and an insertion force (insertion resistance) (see FIG. 18) upon connecting the male terminal 50 and the female terminal 51 according to the second embodiment are similar to those of the first embodiment (a relationship of an insertion stroke and an insertion force relating to connection of the terminals according to the second embodiment is shown by dotted line). In other words, no force for pushing the accumulated plating aside is necessary and an effect of reducing a contact pressure is obtained similar to the first embodiment. As a result, the insertion resistance of the terminals can be reduced.

The invention is not limited to the above described and illustrated embodiments. For example, the following embodiments are also embraced by the technical scope of the present invention as defined by the claims.

Although the resilient contact piece 23 is in the form of a cantilever extending forward in the above embodiments, it may have any shape provided that it is resiliently deformable. For example, the resilient contact piece 23 may be a cantilever extending backward or may be supported at both ends. Although the groove 13 (52) is widened toward the front according to the above embodiments, the groove portion may have any shape provided that the both lateral edges extend in oblique directions with respect to the inserting direction of the tab. For example, the groove portion may extend in an oblique direction with the width thereof fixed or may be narrowed toward the front contrary to the above embodiments. In either shape, an effect of being able to reduce the insertion resistance of the terminals can be obtained.

Although the male terminal 10 and the female terminal 20 are crimped into connection with the ends of the wires in the above embodiment, the terminals may be, for example, connected by soldering, press-fitting, insulation displacement or the like and/or may be at least partly inserted in housings without being limited to the above type.

What is claimed is:

1. A terminal connecting structure for first and second plated terminals to be connected by at least partly inserting a tab of the first terminal into a tube of the second terminal comprising:

a resiliently deformable resilient contact piece in the tube and including a contact with a female contact surface for contacting the tab inserted into the tube;

the tab moving forward in the tube while resiliently deforming the resilient contact piece by sliding a male contact surface of the tab in contact with the female contact surface of the contact and the terminals being connected properly when the tab moves forward to a specified depth in the tube;

at least one groove formed in a part of the female contact surface that slides in contact with the tab or in a part of the male contact surface that slides in contact with the female contact surface, wherein the groove intersects the respective male or female contact surface at lateral edges extending obliquely to an inserting direction of the tab, and a position of the groove defining a maximum width of the groove is at a starting point where the contact with the contact or the tab starts, and a rear end position of the groove defines an ending position for sliding contact with the contact or the tab.

2. The terminal connecting structure of claim 1, wherein a track of sliding contact of the tab extends back along both lateral edges of the groove and extends substantially straight backward from the rear end of the groove.

3. The terminal connecting structure of claim 1, wherein a maximum depth of the groove is smaller than a maximum width thereof and a length of the groove in forward and backward directions is larger than about twice a maximum width thereof.

4. A terminal including a tab to be inserted into a tube of a mating terminal, a resiliently deformable resilient contact piece provided in the tube, the tab having a leading end, upper and lower parallel surfaces spaced rearward of the leading end and upper and lower converging surfaces extending from the parallel surfaces to the leading end, the lower converging surface sliding in contact with a contact portion of the resilient contact piece upon insertion into the tubular portion, wherein a groove is formed in a part of the tab sliding in contact with the contact portion, the groove having a rear end in proximity to an interface between the lower parallel surface and the lower converging surface and the groove intersecting the lower converging surface at lateral edges extending obliquely with respect to an inserting direction of the tab, so that a width between the lateral edges is a minimum at a position substantially adjacent the lower parallel surface.

5. A terminal including a tube for receiving a tab of a mating terminal, comprising:

a resilient contact piece in the tube and including a contact portion with a female contact surface for contacting the tab inserted into the tube;

the resilient contact piece being resiliently deformed by sliding contact of the female contact surface of the contact portion and the tab and the terminal being properly connected with the mating terminal when the tab moves forward up to a specified depth in the tube; and a groove is formed in the contact portion for sliding contact with the tab, the groove intersecting the female contact surface at lateral edges extending obliquely to an inserting direction of the tab, so that a width defined between the lateral edges increases gradually in a forward direction and defines a maximum at a position in proximity to the front end.

6. The terminal of claim 5, wherein a track of sliding contact of the tab extends backward along the both lateral edges of the groove from an intermediate position of the groove and extends substantially straight backward from the rear end of the groove.

7. The terminal of claims 5, wherein a maximum depth of the groove is smaller than a maximum width thereof and a length of the groove in forward and backward directions is larger than about twice a maximum width thereof.

8. The terminal of claim 5, wherein a position of the groove where the width of the groove portion is largest defines a starting point where the contact with the tab starts, and a rear end position of the groove defines an ending position of a sliding contact with the tab.

* * * * *